US005265314A

United States Patent [19]

Enderlin

[11] Patent Number: 5,265,314

[45] Date of Patent: Nov. 30, 1993

[54] PROCESS AND DEVICE FOR CRIMPING YARNS, WITH PRESTEAMING

[75] Inventor: Robert Enderlin, Morschwiller le Bas, France

[73] Assignee: Superba, Mulhouse, France

[21] Appl. No.: 947,760

[22] Filed: Sep. 9, 1992

[30] Foreign Application Priority Data

Sep. 18, 1991 [FR] France ..... 91 11487

[51] Int. Cl.[5] ..... D02G 1/14; F26B 13/00; D08B 3/12

[52] U.S. Cl. ..... 28/278; 34/155; 68/5 D

[58] Field of Search ..... 28/278; 68/5 C, 5 D; 34/23, 155

[56] References Cited

U.S. PATENT DOCUMENTS

| | | | |
|---|---|---|---|
| 3,816,583 | 6/1974 | Kashima et al. . | |
| 4,515,561 | 5/1985 | Melgaard | 34/155 X |
| 4,654,980 | 4/1987 | Bhat | 34/23 X |
| 4,718,257 | 1/1988 | Reinehr et al. | 68/5 D X |
| 5,092,139 | 3/1992 | Runser | 68/5 D |
| 5,134,866 | 8/1992 | Enderlin | 68/5 D |

FOREIGN PATENT DOCUMENTS

| | | | |
|---|---|---|---|
| 3407909 | 9/1984 | Fed. Rep. of Germany . | |
| 695582 | 8/1953 | United Kingdom | 68/5 D |
| 904918 | 9/1962 | United Kingdom . | |

*Primary Examiner*—Clifford D. Crowder
*Assistant Examiner*—John J. Calvert
*Attorney, Agent, or Firm*—Young & Thompson

[57] ABSTRACT

In the crimping process the yarns (1) are introduced continuously into a crimping machine (3) in which they are subjected to a compression which has the effect of crimping them.

Before being introduced into the crimping machine (3) the yarns (1) are subjected to a presteaming operation in a chamber (6).

Use especially for improving the bulk of the yarns before they are crimped.

2 Claims, 5 Drawing Sheets

PROCESS AND DEVICE FOR CRIMPING YARNS, WITH PRESTEAMING

FIELD OF THE INVENTION

The present invention relates to a process and a device for pretreating a yarn before it is introduced into a crimping machine.

This process and this device can in principle be applied to any yarns to be crimped, such as polyamides, polyesters, polypropylenes, acrylics, wools and mixtures thereof. These yarns may be simple yarns or twist yarns.

PRIOR ART

The crimping machine may be placed between the feed rack and the entry of a heat-setting plant like that described, for example, in French Patent Application No. 2,655,064 in the name of the Applicant Company.

The crimped and heat-set yarns obtained can be employed in the manufacture of carpets and moquettes.

A crimping machines treats a large number of yarns simultaneously.

In the case of BCF-type continuous filaments the yarns are first of all introduced into a so-called "false twist" spindle driven with an alternating rotational motion of variable amplitude. The yarns are then carried along by being pinched between two rollers and are introduced into a compression chamber in which they are subjected to the actual crimping operation.

After this crimping operation the yarns travel along a chute as far as the conveyor belt of the heat-setting plant.

In the case of yarns other than those of the BCF type, the abovementioned "false twist" operation is short-circuited and the yarns are introduced directly between the two driving rollers. A crimping machine of the above type was described, for example, in French Patent Application 89/12,868 of Sept. 28, 1989 in the name of the Applicant Company.

This crimping machine comprises a steam circuit allowing steam to be injected into the compression chamber. This steam injection makes it possible to increase the bulk of the yarn, to fix and to amplify the crimp and to stabilize the latter before it enters the heat-setting plant.

The objective of the present invention is to provide improvements to the known processes and devices for crimping yarns.

SUMMARY OF THE INVENTION

The invention thus relates to a process for crimping yarns in which the yarns are introduced continuously into a crimping machine in which they are subjected to a compression which has the effect of crimping them.

According to the crimping process of the invention, before being introduced into the crimping machine, the yarns are subjected to a presteaming operation.

This presteaming operation consists in treating the yarns in a chamber into which steam is injected under pressure in the saturated or superheated state. The steam pressure varies, depending on the nature of the yarns, approximately between 0.1 and 0.5 bar (above atmospheric pressure). The temperature of this steam varies approximately between 80° and 100° C.

Experiment has shown that this presteaming of the yarns before crimping brought the following advantages:

It endows the yarns with a bulk which opens the turns and gives them a better elasticity. Because of this the yarns retain their geometry, especially their circular section, after passing between the driving rolls or rollers which precede the crimping machine.

Thus, the yarns presteamed in accordance with the invention are presented for the subsequent crimping operation in the best optimized manner possible, and this promotes the crimping, making it more effective, more uniform and more stable.

These improvements result in an appreciable improvement in the quality of the finished products obtained from the crimped yarns treated in accordance with the invention.

According to another aspect of the invention the device for making use of the process according to the invention comprises two substantially coaxial chambers comprising, at their opposite axial ends, passage openings for the yarns, a circuit for feeding steam under pressure comprising at least one steam injection pipe emerging into the first chamber which is surrounded by the second chamber, this first chamber having openings allowing the steam to escape into the space included between the two chambers and the second chamber comprising at least one steam discharge pipe, these two chambers being arranged upstream of a crimping machine.

The steam is thus injected firstly into the first chamber or inner chamber, through which the yarns run continuously. The steam thus preheats and moistens the yarns continuously to give them the properties indicated above. The steam escapes from this inner chamber through openings to enter the second chamber which surrounds the preceding one, and then escapes from this second chamber through a pipe.

The first chamber is thus surrounded by a space filled with steam originating from this chamber. This steam space thermally insulates the first chamber from the surrounding atmosphere, and this makes it possible to produce a perfectly homogeneous temperature inside the first chamber, which is beneficial with regard to the properties which are required of the yarns.

In addition, by virtue of the thermal insulation obtained, any water condensation on the inner surface of the first chamber is avoided and consequently any fall of water droplets onto the yarns which are capable of affecting the quality of the latter.

Other special features and advantages of the invention will appear further from the description below.

BRIEF DESCRIPTION OF THE DRAWINGS

In the attached drawings, which are given by way of example without any limitation being implied.

DESCRIPTION OF THE PREFERRED EMBODIMENT(S)

Figure 1:
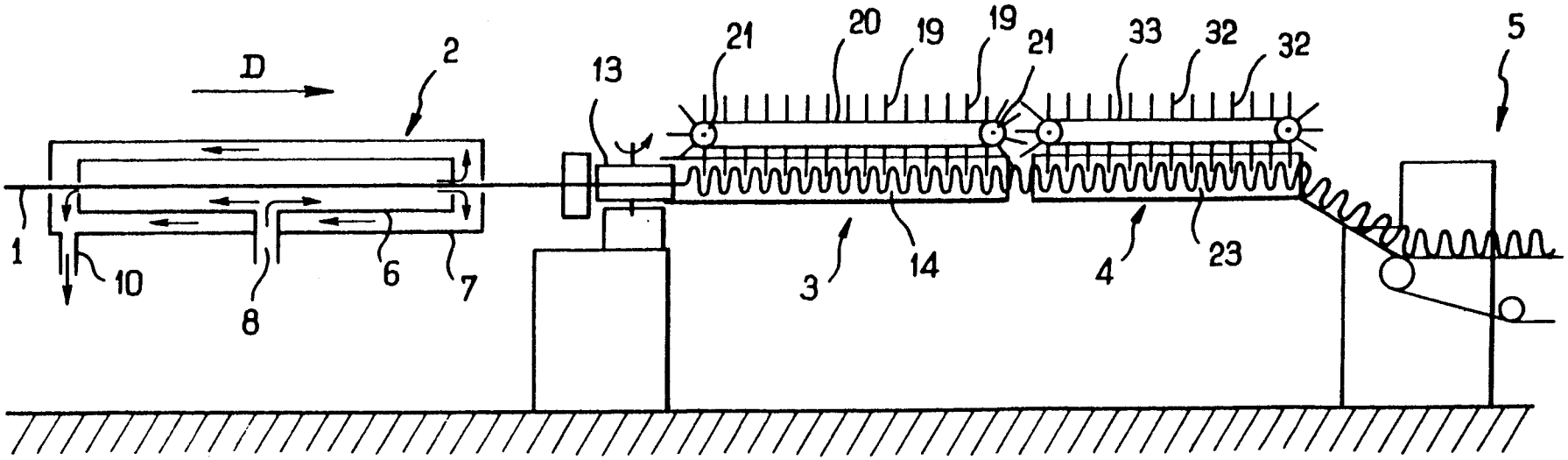
FIG. 1 is a diagrammatic plan and sectional view of a crimping machine preceded by presteaming chamber and followed by a relaxation chamber.

As shown in FIG. 1 the plant for the treatment of a yarn 1 made of textile fibers comprises mainly, following the direction of travel D of the yarn 1, a presteaming chamber 2 followed by a crimping machine 3 and a relaxation chamber 4 which itself precedes a heat-setting plant 5. The latter may be of the type of that described in French Patent Application No. 2,655,064 in the name of the Applicant Company.

In accordance with a first improvement of the invention, before being introduced into the crimping machine, the yarns 1 are subjected to a presteaming operation in the chamber 2.

This presteaming is performed with steam which is generally at a pressure of approximately between 0.1 and 0.3 bar and at a temperature of approximately between 80° and 100° C.

The device for carrying out the presteaming operation comprises (see FIGS. 2 and 3) two substantially coaxial chambers 6, 7 comprising at their opposite axial ends passage openings 6*a*, 6*b*; 7*a*, 7*b* for the yarns 1.

These chambers 6, 7 are connected to a feed circuit for steam under pressure, comprising a steam injection pipe 8 emerging into the first chamber 6 which is surrounded by the second chamber 7.

The first chamber 6 has openings 6*a*, 6*b* allowing the steam to escape into the space 9 included between the two chambers 6, 7.

The second chamber 7 comprises a steam discharge pipe 10.

These two chambers 6, 7 are arranged upstream of and close to a crimping machine 3 which will be described later.

Figure 2:
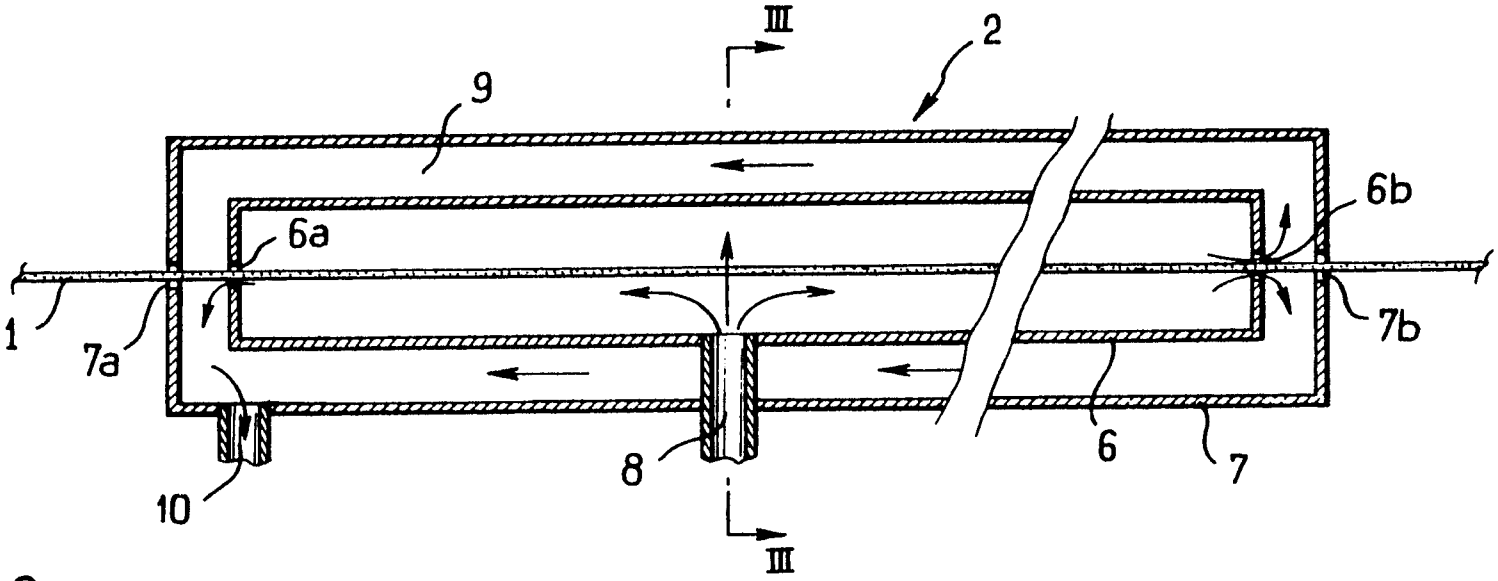
FIG. 2 is a view of the presteaming chamber in lengthwise section with cutaway.

In FIG. 2 it is seen that the openings 6*a*, 6*b* of the first chamber 6, which allow steam to escape into the space 9, correspond to the openings situated at the opposite axial ends of this chamber 6. However, other openings could be provided in this chamber 6.

Figure 3:
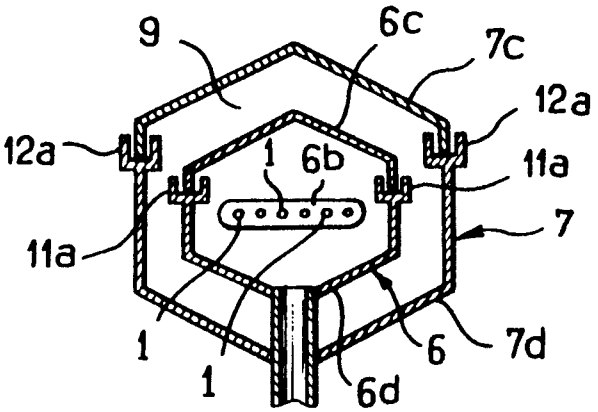
FIG. 3 is a view in section along the plane III—III of FIG. 2.

In the embodiment shown in FIG. 3, each of the two chambers 6, 7 consists of two half-shells 6*c*, 6*d*; 7*c*, 7*d* resting one on the other via their respective edges situated in a horizontal plane. The edge of the lower half-shell 6*d*, 7*d* has a groove 11*a*, 12*a* in which the edge of the upper half-shell 6*c*, 7*c* is engaged. This groove 11*a*, 12*a* is adapted to receive the water condensed on the inner surface of the upper half-shell 6*c*, 7*c* in order to form a seal.

The steaming device 2 just described functions in the following manner:

The yarns to be treated 1 continuously cross the chamber 6 passing successively through the axial openings 7*a*, 6*a*, 6*b*, 7*b*. Steam is injected into the inner chamber 6 by the pipe 8. It leaves it by the openings 6*a*, 6*b* and enters the space 9 included between the two chambers 6, 7, from where it leaves by the pipe 10. During their passage through the chamber 6 the yarns are heated and moistened by the steam, and this has the effect of giving them a certain bulk which has a beneficial effect, bearing in mind the subsequent treatments.

The steam-filled space 9 thermally insulates the inner chamber 6 with regard to the surrounding atmosphere and prevents excessive condensation of water on the inner surface of the chamber. However, the grooves 11*a*, 12*a* fill with condensed water, and this forms substantially leakproof water seals enabling a slight steam overpressure to be maintained in the inner chamber 6.

The crimping machine 3 will now be described with reference to FIGS. 4, 5 and 6.

This machine 3 essentially comprises a pair of rollers 13 between which each yarn 1 is pinched and which conveys it into a compression chamber 14.

The particular structure of this compression chamber 14 has been described in French Patent Application 89/12,868 of Sep. 28, 1989 in the name of the Applicant Company.

Figure 6:
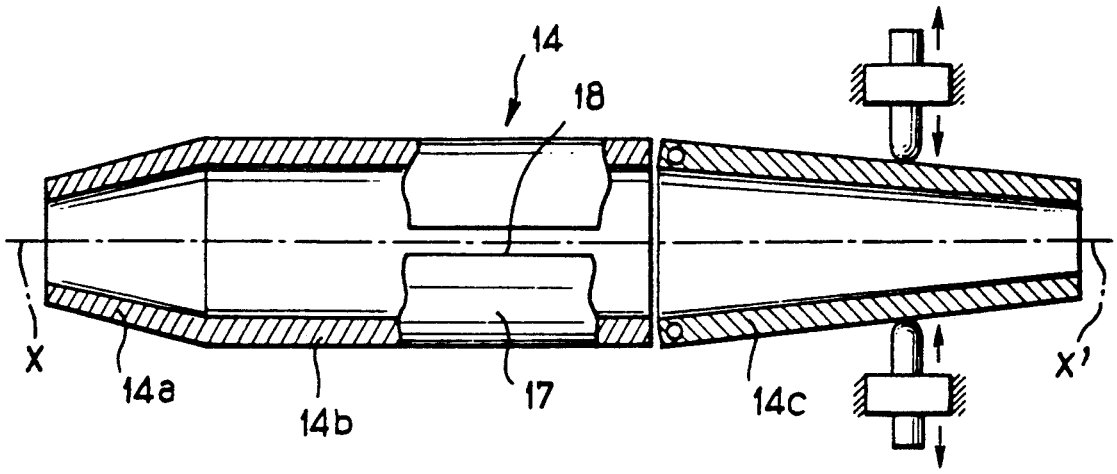
FIG. 6 is a view from above and in lengthwise section of the compression chamber of the crimping machine, the driving system having been removed.

The general shape of this chamber 14 can be seen in FIG. 6.

At its entry it comprises a part 14*a* which widens abruptly, followed by a part 14*b* which widens much more progressively and which terminates in an end part 14*c* whose section narrows down progressively by virtue of two walls which are movable in relation to the axis X—X' of the chamber.

Figures 4, 5:
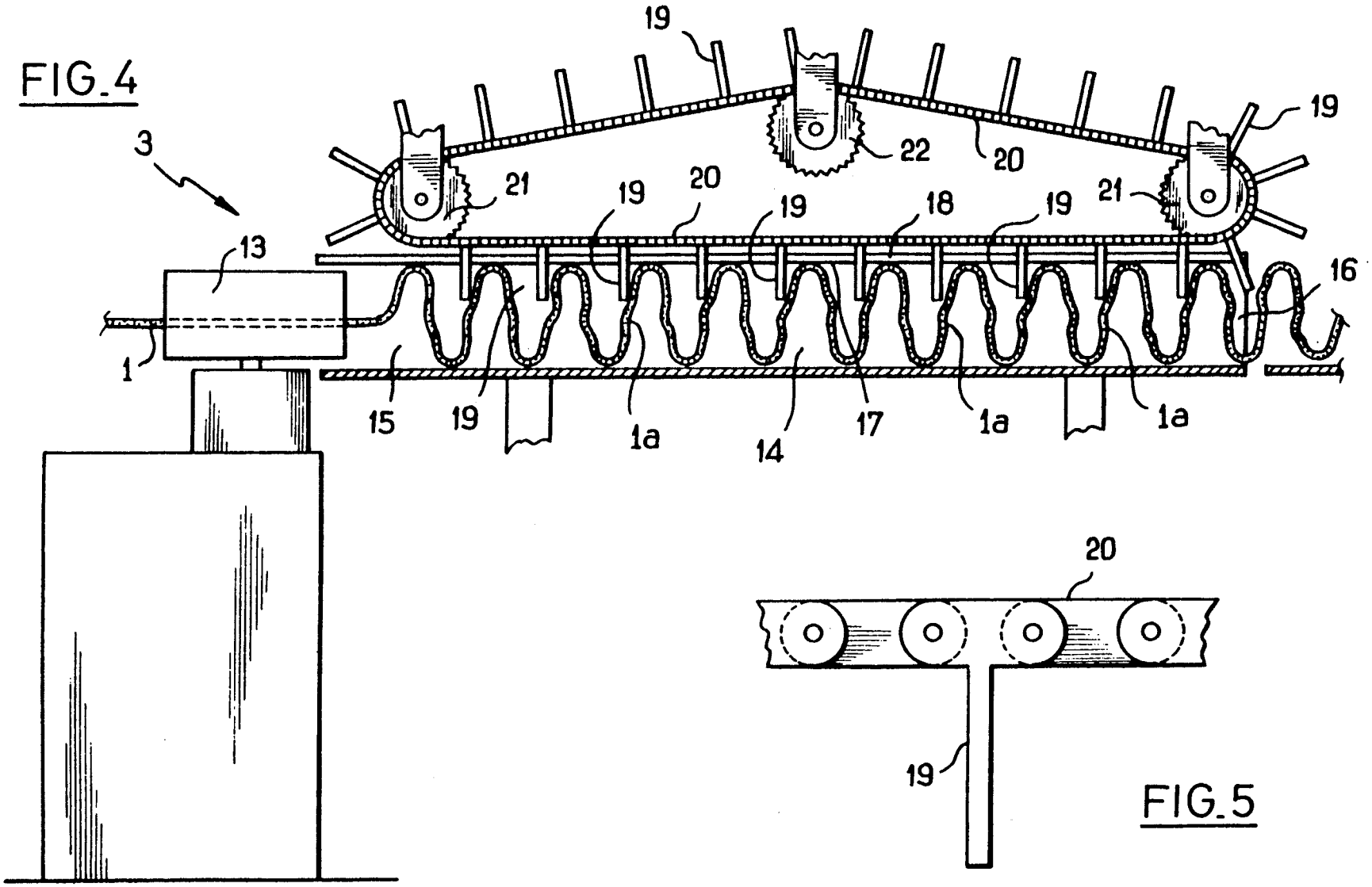
FIG. 4 is a view of the crimping machine in lengthwise section.
FIG. 5 is a view of detail on a larger scale of a part of the system for driving the crimped yarn.

A consequence of this particular shape of the chamber 14 is that when the yarn enters the latter it is subjected to a compacting which gives rise to the formation of turns or crimps as shown in FIG. 4.

The yarn crimping machine 3 thus generally comprises an elongate chamber 14 comprising at one of its ends an opening 15 for introducing the yarn to be crimped 1 and, at its other end, an exit opening 16 for the crimped yarn. Means which are known per se are provided for subjecting the yarn 1 to an axial compression directed in a direction opposite to its direction of forward travel in the chamber 14. In accordance with another improvement of the invention the wall 17 of the chamber 14 comprises (see FIG. 6) an elongate opening 18 parallel to the axis X—X' of this chamber 14, in which are engaged fingers 19 uniformly distributed along this opening 18. Means are provided for moving the fingers 19 in order to allow the latter to move the crimped yarn 1 positively towards the exit opening 16 of the chamber 14.

In the example shown in FIG. 4 the means for moving the fingers 19 comprise a chain 20 wound around two toothed wheels 21 placed near the ends of the elongate opening 18. This chain 20 carries the fingers 19 and one of the wheels 21 is connected to a motor which is not shown, to drive it in rotation.

A third toothed wheel 22 is provided to tension the chain 20.

The chain 20 can, of course, be replaced by a belt wound around two pulleys placed near the ends of the elongate opening, this belt carrying the fingers 19 and one of the pulleys being connected to a motor to drive it in rotation.

In the example shown in FIGS. 4 and 6 the elongate opening 18 is made in the upper part of the chamber 14 and the chain 20 runs just above the opening 18.

The device shown in FIG. 4 functions in the following manner:

The fingers 19 driven by the chain 20 enter between the turns or crimps 1*a* of the yarn and thus propel the whole crimped yarn towards the exit of the chamber 14.

By virtue of these fingers 19 which are uniformly spaced, for example at 50 mm, the crimped yarn 1 leaves the chamber 14 with very uniform crimping. The uniformity of this crimping has a highly beneficial effect on the quality of the final product obtained.

Furthermore, by virtue of this positive drive by the fingers 19 the forward travel of the yarn is not affected by friction along the chamber which depend on the degree of humidity and the treatments which have been performed beforehand.

Figure 8:
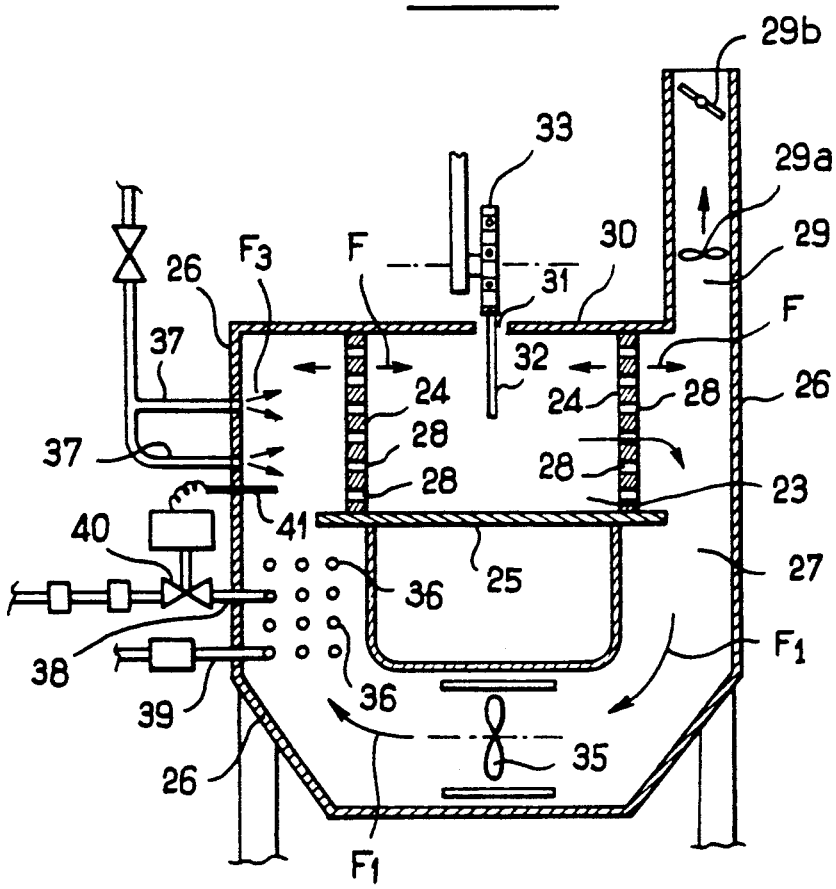
FIG. 8 is a view in section along the plane VIII—VIII of FIG. 7.
Figure 7:
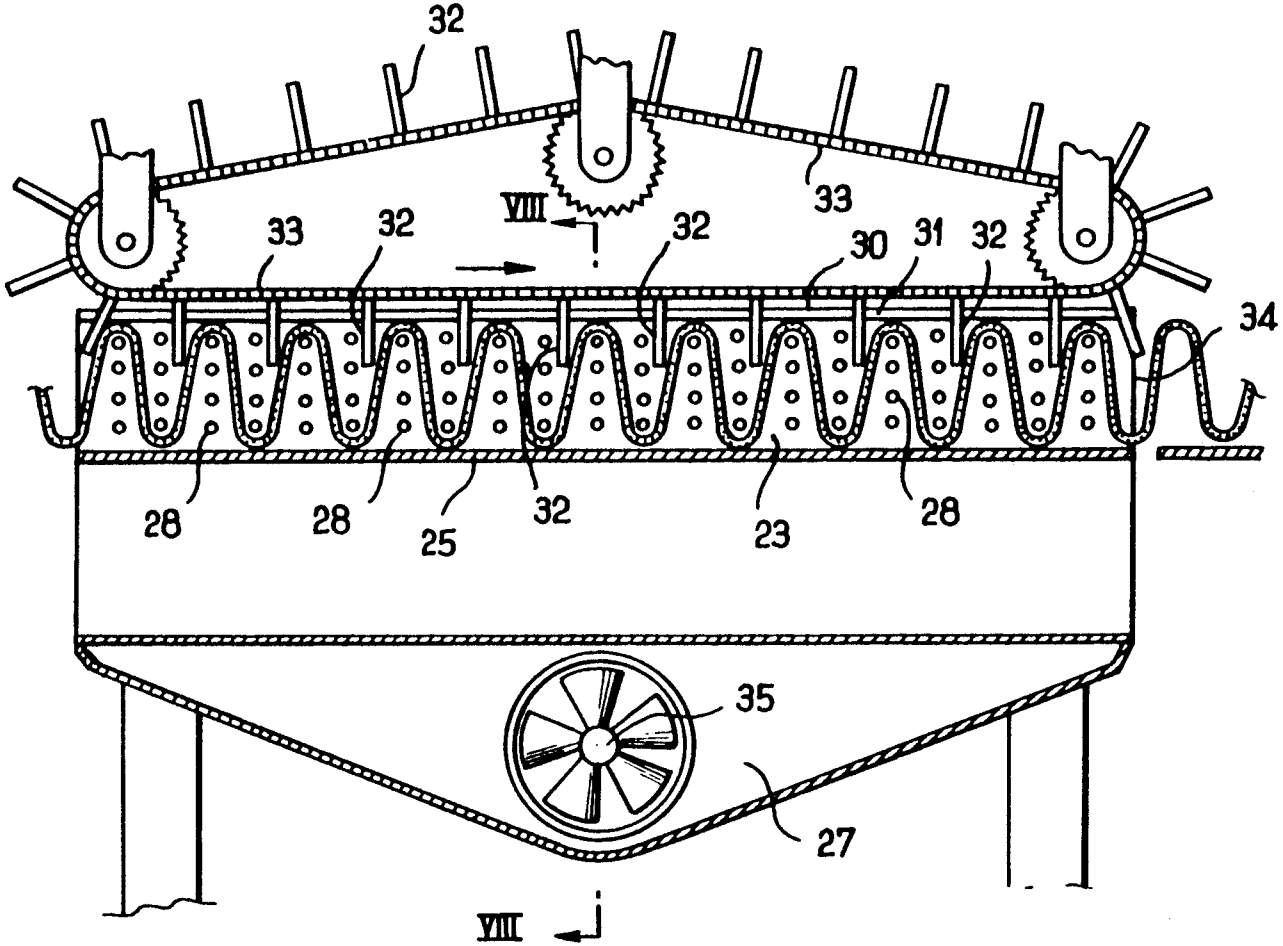
FIG. 7 is a view of the relaxation chamber and its accessories in lengthwise section.

As shown in FIG. 1, the elongate chamber 14 of the crimping machine is followed by a second chamber 23 which is shown in greater detail in FIGS. 7 and 8. This second chamber 23 has a section which is equal to or slightly larger than that of the first chamber 14. This second chamber 23 is arranged so as to relax the crimped yarn 1 which has entered it.

In addition, this second chamber 23 has two perforated side walls 24 (see FIG. 8). These, as well as the lower wall 25 of the chamber, being surrounded by an enclosure 26 defining with the above walls a space 27 which communicates with the interior of the chamber 23 through the perforations 28 of said side walls 24 and with the exterior through a chimney 29. Means are additionally provided for introducing steam and/or hot air into said space 27.

In FIGS. 7 and 8 it is also seen that the upper wall 30 of the second chamber 23 comprises an elongate opening 31 parallel to the axis of the chamber. In this elongate opening 31 are engaged fingers 32 uniformly spaced along this opening. As in the case of FIG. 4, a chain 33 is provided for moving the fingers 32 to enable the latter to move the crimped yarn positively towards the exit opening 34 of this second chamber 23.

In FIG. 8 it is seen, furthermore that the side walls 24 of the second chamber 23 are mounted slidably in a direction (see arrows F) perpendicular to their plane to be able to regulate the width of this chamber 23.

Moreover, a fan 35 is provided inside the space 27, arranged so as to circulate the steam and/or hot air along a closed circuit which passes through the perforated side walls 24 of the chamber 23.

Furthermore, heating means 36 are provided inside the space 27 to heat the steam and/or air circulating in said space 27.

In the example of FIG. 8 the steam is injected at the top of the space 27 into a region situated opposite one of the perforated walls 24, by pipes 37.

Moreover, heating of the air blown by the fan 35 is carried out by a tube bundle 36 through which steam circulates. This tube bundle 36 is arranged between the fan 35 and the steam injection region, so that the air blown by the fan passes through the tube bundle 36 and is heated by the latter before entering the chamber 23.

The tube bundle 36 is connected to steam pipes 38, 39 equipped with a pressure reducer, valves and the like. The steam flow rate can be regulated by virtue of a solenoid valve 3 controlled by a temperature probe 41 arranged in the space 27.

The relaxation chamber 23 just described offers many advantages.

On the one hand it makes it possible to carry out the relaxation of the crimped yarn leaving the compacting chamber 14 under optimum conditions for the following two reasons:

by virtue of the positive drive performed by the fingers 32, which allows the crimping to be kept uniform, by virtue of the possibility of the width of the chamber 23 being adjustable as a function of the nature of the yarn and of the treatment which has been applied to it.

In addition, the steam treatment makes it possible to improve the bulk of the yarn.

When the yarn is treated with hot air, it is dried, and this enables it to reabsorb the moisture under excellent conditions in the heat-setting plant.

The invention is, of course, not limited to the examples just described and numerous modifications can be made thereto without departing from the scope of the invention.

Thus, the presteaming chamber could also consist of a single chamber with an entry and an exit for steam under pressure. To avoid water condensation on the wall of the chamber, the latter could be surrounded externally with heating means such as an electric resistor.

What is claimed is:

1. Apparatus for treating yarns, comprising a crimping machine into which the yarns are introduced continuously to be subjected to a compression which has the effect of crimping them, and a presteaming device arranged upstream of said crimping machine, said presteaming device comprising two substantially coaxial chambers comprising passage openings for the yarn at opposite axial ends thereof, a circuit for feeding steam under pressure comprising at least one steam injection pipe emerging into the first of said chambers the second of said chambers surrounding the first chamber, the first chamber having openings allowing the steam to escape into a space between the two coaxial chambers, said openings of the first chamber comprising said passage openings situated at the opposite axial ends of the first chamber, and the second chamber comprising at least one steam discharge pipe.

2. Apparatus as claimed in claim 1, each of said two chambers comprising two half-shells resting one on the other via respective edges situated in a horizontal plane, an edge of the lower half-shell having a groove in which an edge of the upper half-shell is engaged, said groove being adapted to collect water condensed on an inner surface of the upper half-shell to form a water seal.

* * * * *